US008397548B1

(12) United States Patent
Lin

(10) Patent No.: US 8,397,548 B1
(45) Date of Patent: Mar. 19, 2013

(54) REVERSIBLE MORTISE LOCK FOR A STORM DOOR

(76) Inventor: Kun-Long Lin, Taichung (TW)

( * ) Notice: Subject to any disclaimer, the term of this patent is extended or adjusted under 35 U.S.C. 154(b) by 0 days.

(21) Appl. No.: 13/444,052

(22) Filed: Apr. 11, 2012

(51) Int. Cl.
*E05B 63/04* (2006.01)

(52) U.S. Cl. ..... 70/462; 70/107; 70/451; 70/466; 292/244

(58) Field of Classification Search ..... 70/107, 70/448, 450, 451, 462, 466; 292/244
See application file for complete search history.

(56) References Cited

U.S. PATENT DOCUMENTS

| | | | | | |
|---|---|---|---|---|---|
| 29,929 | A * | 9/1860 | Whitney | 292/244 |
| 39,203 | A * | 7/1863 | Munger | 292/244 |
| 40,829 | A * | 12/1863 | Erbe | 292/244 |
| 61,090 | A * | 1/1867 | Oppenheimer | 292/244 |
| 77,966 | A * | 5/1868 | Erbe | 292/244 |
| 85,497 | A * | 12/1868 | Whitney | 292/244 |
| 92,354 | A * | 7/1869 | Pfleghar | 292/244 |
| 2,068,737 | A * | 1/1937 | De Vries Abraham | 292/244 |
| 3,955,387 | A * | 5/1976 | Best et al. | 70/224 |
| 4,052,092 | A * | 10/1977 | Bergen | 292/172 |
| 4,988,133 | A * | 1/1991 | Shih | 292/191 |
| 5,123,684 | A * | 6/1992 | Yeh | 292/244 |
| 5,678,870 | A * | 10/1997 | Pelletier | 292/244 |
| 5,813,255 | A * | 9/1998 | Tell et al. | 70/107 |
| 6,393,878 | B1 * | 5/2002 | Fayngersh et al. | 70/107 |
| 7,108,300 | B2 * | 9/2006 | Hodgin et al. | 292/244 |
| 7,510,222 | B2 * | 3/2009 | Hodgin et al. | 292/244 |
| 8,261,584 | B2 * | 9/2012 | Yang | 70/107 |
| 2007/0114800 | A1 * | 5/2007 | Kuo | 292/244 |
| 2008/0246288 | A1 * | 10/2008 | Hodgin et al. | 292/244 |
| 2009/0189399 | A1 * | 7/2009 | Hodgin et al. | 292/244 |
| 2011/0210566 | A1 * | 9/2011 | Chen | 292/244 |

* cited by examiner

*Primary Examiner* — Suzanne Barrett
(74) *Attorney, Agent, or Firm* — Ming Chow; Sinorica, LLC

(57) ABSTRACT

A reversible mortise lock for a storm door has a body, a latchbolt and an operational set. The body has two sidewalls, an actuator and a lock body plate. The latchbolt is connected to the actuator between the sidewalls and the lock body plate and has a connecting rod, a bolt head and a first spring. The connecting rod is connected to the actuator. The bolt head is mounted on the connecting rod and extends to the lock body plate. The first spring is mounted around the connecting rod. The operating set is movably connected to the body and the latchbolt and has an engaging panel and a second spring. The engaging panel is movably mounted between the sidewalls, is mounted around and selectively engages the connecting rod and has multiple pushing levers, a through hole and an engaging protrusion. The second spring is mounted on the engaging panel.

6 Claims, 8 Drawing Sheets

REVERSIBLE MORTISE LOCK FOR A STORM DOOR

BACKGROUND OF THE INVENTION

1. Field of the Invention

The present invention relates to a reversible mortise lock, and more particularly to a reversible mortise lock for a storm door to change the assembling direction of a latchbolt quickly and conveniently.

2. Description of Related Art

With reference to FIGS. 6 and 7, a conventional reversible mortise lock 50 for a storm door has a body 51, an actuator 52, a lock body plate 53 and a latchbolt 54. The body 51 may be rectangular and has two sidewalls 511. The sidewalls 511 face to each other and each sidewall 511 has an outer side. The actuator 52 is rotatably mounted in the body 51 between the sidewalls 511 and is used to connect to a knob. The lock body plate 53 is securely connected to the body 51 on the outer sides of the sidewalls 511 of the body 51 by fasteners 531 and has a latch hole 532 formed through the lock body plate 53. The latchbolt 54 is pressably connected to the actuator 52 between the body 51 and the lock body plate 53 and has an inner end, an outer end, a bolt head 541 and a spring 542. The inner end of the latchbolt 54 extends between the sidewalls 511 of the body 51 and is movably mounted through and connected to the actuator 52. The outer end of the latchbolt 54 extends toward the latch hole 532 of the lock body plate 53. The bolt head 541 is mounted on the outer end of the latchbolt 54 and extends through the latch hole 532 of the lock body plate 53. The spring 542 is mounted around the latchbolt 54 between the bolt head 54 and the actuator 52.

In use, the storm door may be a pull-type or a push-type storm door to enable the users to open the storm door by pulling or pushing the storm door, and the bolt head 541 of the latchbolt 54 of the conventional reversible mortise lock 50 needs to change the assembling direction to fit with the types of the storm door. With reference to FIG. 8, when the assembling direction of the bolt head 541 of the latchbolt 54 needs to be changed, the lock body plate 53 is separated from the sidewalls 511 by loosening the fasteners 531 to disengage the bolt head 541 of the latchbolt 54 from the latch hole 532 of the lock body plate 53. Then, the latchbolt 54 is rotated relative to the actuator 52 to change the direction of the bolt head 541. After changing the direction of the bolt head 541, the lock body plate 53 is securely connected to the body 51 again to hold the bolt head 541 of the latchbolt 54 in the desired direction. However, the lock body plate 53 of the conventional reversible mortise lock 50 needs to be separated from the body 51 by loosening the fasteners 531 before changing the direction of the bolt head 541 of the latchbolt 54, and this is inconvenient in operation and takes time to assemble and disassemble the lock body plate 53 with and from the body 51.

To overcome the shortcomings, the present invention provides a reversible mortise lock for a storm door to mitigate or obviate the aforementioned problems.

SUMMARY OF THE INVENTION

The primary objective of the present invention is to provide a reversible mortise lock for a storm door that can rotate the direction of a latchbolt of the reversible mortise lock. Depending on whether your door is hinged on right side or left side you may have to change the position of the latchbolt quickly and conveniently.

The reversible mortise lock for a storm door in accordance with the present invention has a body, a latchbolt and an operational set. The body has two sidewalls, an actuator and a lock body plate. The latchbolt is connected to the actuator between sidewalls and the lock body plate and has a connecting rod, a bolt head and a first spring. The connecting rod is movably and rotatably connected to the actuator. The bolt head is mounted on the connecting rod and extends to the lock body plate. The first spring is mounted around the connecting rod. The operating set is movably connected to the body and the latchbolt and has an engaging panel and a second spring. The engaging panel is movably mounted between the sidewalls, is mounted around and selectively engages the connecting rod and has multiple pushing levers, a through hole and an engaging protrusion. The second spring is mounted on the engaging panel.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
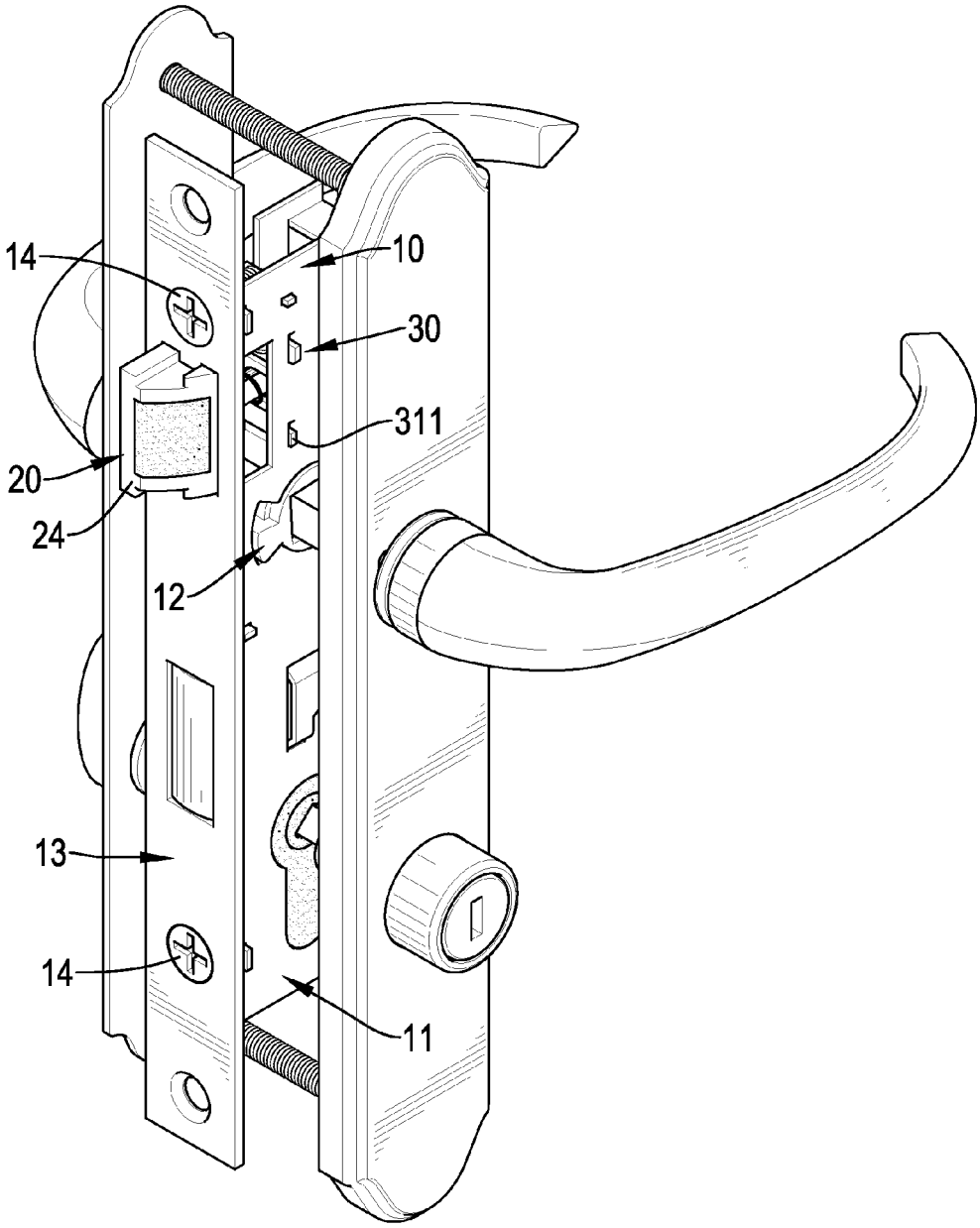
FIG. 1 is a perspective view of a reversible mortise lock for a storm door in accordance with the present invention mounted with a knob assembly of a storm door.
Figure 2:
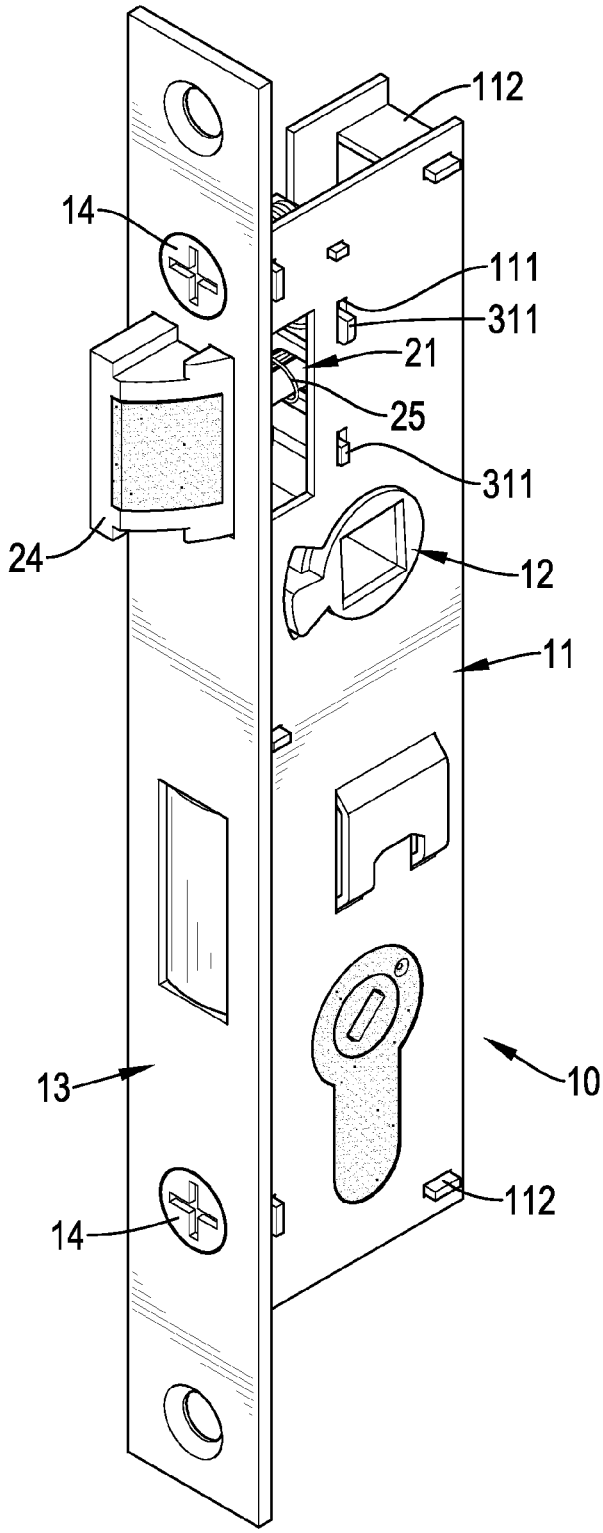
FIG. 2 is an enlarged perspective view of the reversible mortise lock for a storm door in FIG. 1.
Figure 3:
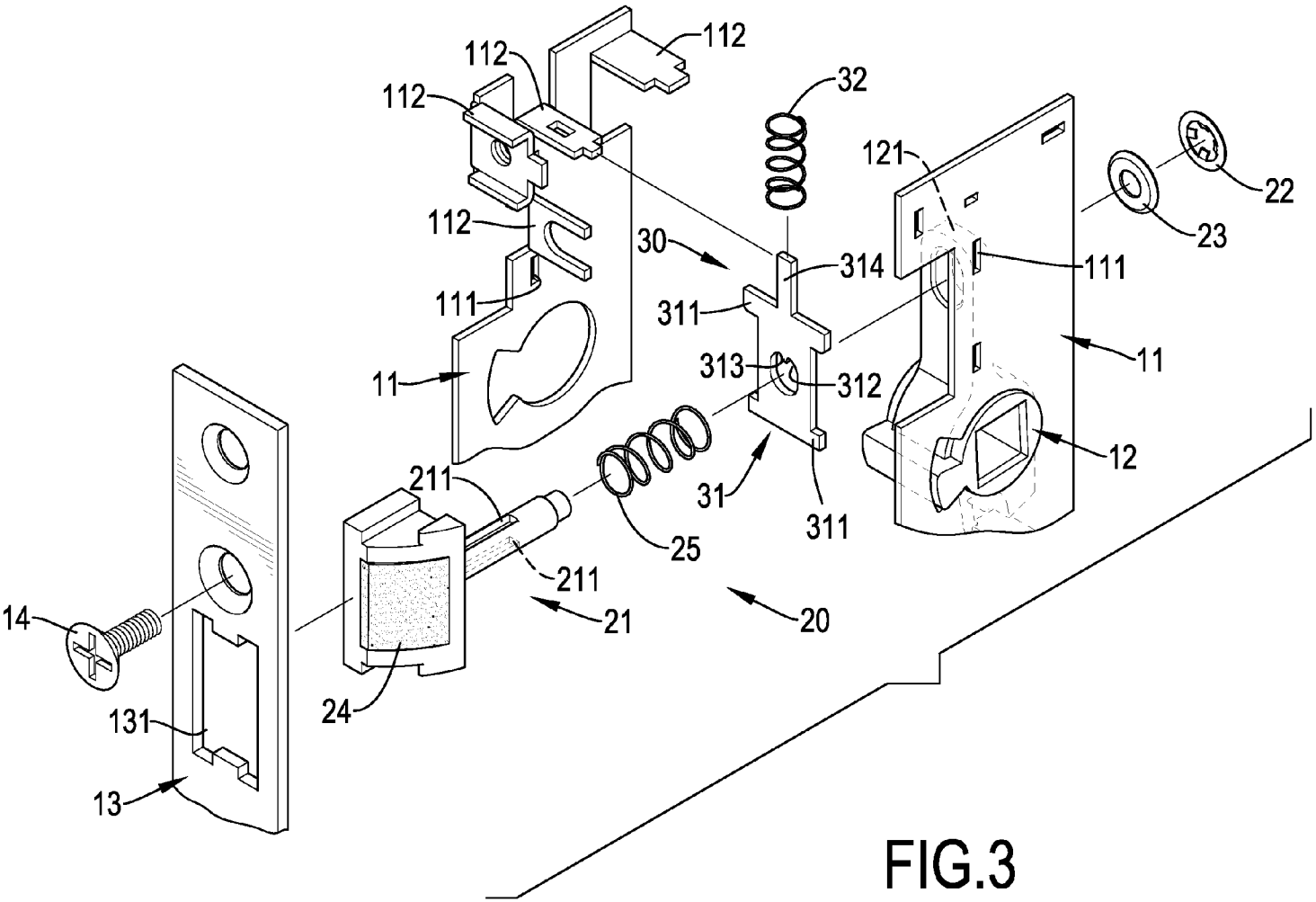
FIG. 3 is an exploded perspective view of the reversible mortise lock in FIG. 1.
Figure 4:
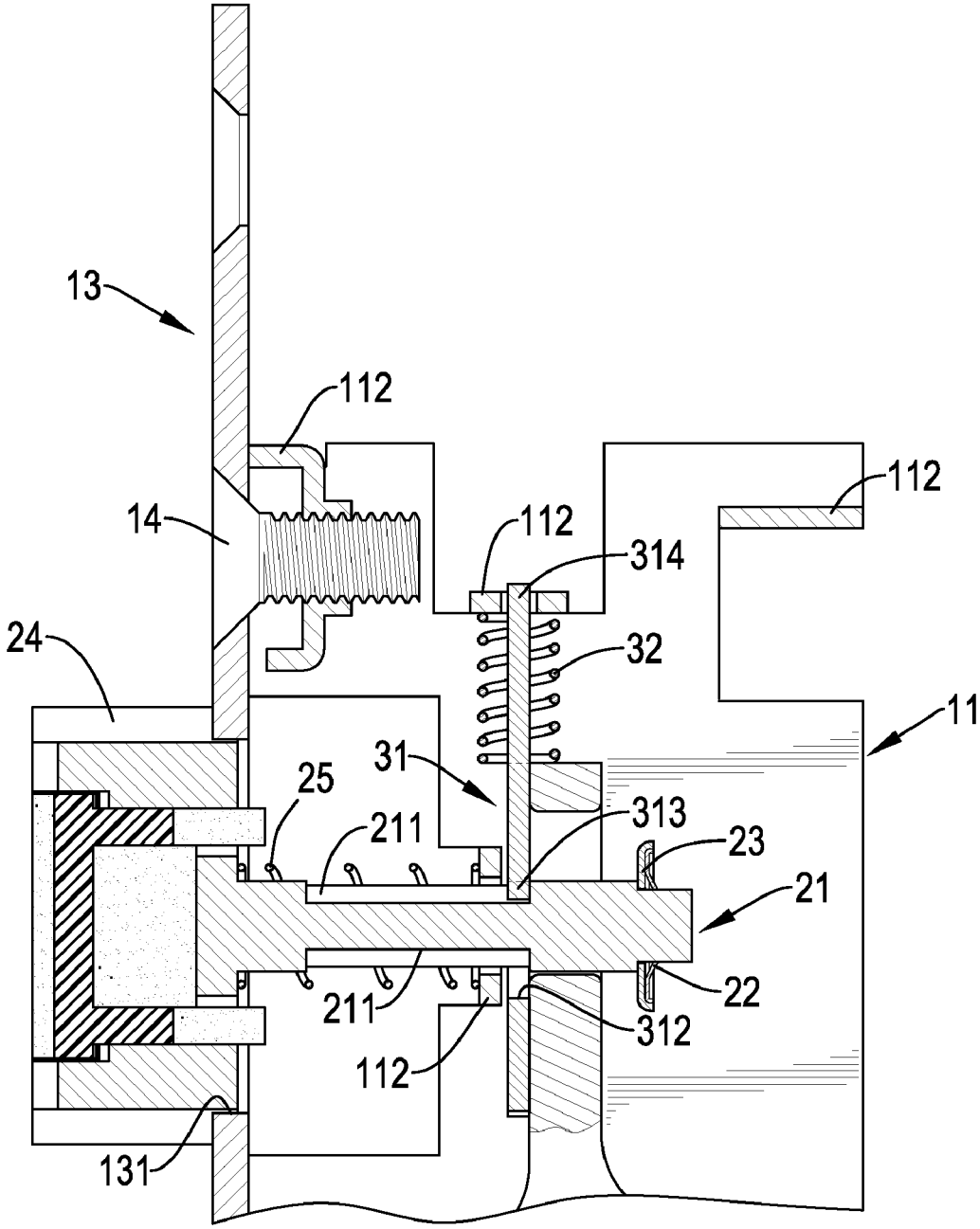
FIG. 4 is an enlarged side view in partial section of the reversible mortise lock in FIG. 1.

With reference to FIGS. 1 to 4, a reversible mortise lock for a storm door in accordance with the present invention has a body 10, a latchbolt 20 and an operational set 30.

The body 10 has two sidewalls 11, an actuator 12 and a lock body plate 13. The sidewalls 11 may be rectangular and are connected to each other by multiple connecting wings 112, and each sidewall 11 has an outer side and at least one holding hole 111. The at least one holding hole 111 is formed through the sidewall 11 and align with the at least one holding hole 111 of the other sidewall. Preferably, each sidewall 11 has two holding holes 111 formed through the sidewall 11 and are arranged in a line.

The actuator 12 is rotatably mounted in the body 10 between the sidewalls 11 and has a connecting end 121 extending upwardly between the sidewalls 11 of the body 10. The lock body plate 13 is securely connected to the outer sides of the sidewalls 11 by fasteners 14 and has a latch hole 131 formed through the lock body plate 13.

The latchbolt 20 is pressably connected to the actuator 12 between the sidewalls 11 and the lock body plate 13 of the body 10 and has a connecting rod 21, a holding ring 22, a washer 23, a bolt head 24 and a first spring 25.

The connecting rod 21 is movably and rotatably connected to the connecting end 121 of the actuator 12 and has an inner end, an outer end, an external surface and two engaging recesses 211. The inner end of the connecting rod 21 extends between the sidewalls 11 of the body 10 and is movably and rotatably mounted through the connecting end 121 of the actuator 12. The outer end of the connecting rod 21 extends toward the latch hole 131 of the lock body plate 13. The engaging recesses 211 are formed in the external surface of the connecting rod 21 between the ends of the connecting rod 21.

The holding ring 22 is securely mounted around the inner end of the connecting rod 21 to prevent the connecting rod 21 from separating from the actuator 12. The washer 23 is mounted around the connecting rod 21 between the connecting end 121 of the actuator 12 and the holding ring 22. The bolt head 24 is mounted on the outer end of the connecting rod 21 and extends through the latch hole 131 of the lock body plate 13. The first spring 25 is mounted around the connecting rod 21 between the bolt head 24 and one of the connecting wings 112 of the body 10.

The operating set 30 is movably connected to the body 10 and the latchbolt 20 and has an engaging panel 31 and a second spring 32.

The engaging panel 31 is movably mounted between the sidewalls 11 of the body 10, is mounted around and selectively engages the connecting rod 21 of the latchbolt 20 between the corresponding connecting wing 112 and the connecting end 121 of the actuator 12 and has a top end, a bottom end, two opposite sides, at least two pushing levers 311, a through hole 312, an engaging protrusion 313 and a guiding slice 314. The opposite sides of the engaging panel 31 respectively face the sidewalls 11 of the body 10.

The at least two pushing levers 311 are respectively formed on and protrude from the opposite sides of the engaging panel 31 and are respectively mounted in and extend out of the holding holes 111 of the sidewalls 11 of the body 10. Preferably, the engaging panel 31 has two pushing levers formed on and protruding from each of the opposite sides at the top end and the bottom end of the engaging panel 31.

The through hole 312 is formed through the engaging panel 31 between the ends of the engaging panel 31 and is mounted around the connecting rod 21 of the latchbolt 20. The engaging protrusion 313 is formed on and protrudes from the engaging panel 31, extends in the through hole 312 and selectively engages an end of one of the engaging recesses 211 of the connecting rod 21 to hold the connecting rod 21 at a position to prevent the latchbolt 24 from disengaging from the latch hole 131 of the lock body plate 13. In addition, when the engaging protrusion 313 engages one of the engaging recesses 211 of the connecting rod 21, the bolt head 24 cannot be rotated relative to the lock body plate 13. The guiding slice 314 is formed on and protrudes upwardly from the top end of the engaging panel 31 between the sidewalls 11 and extends into one of the connecting wings 112 of the body 10.

The second spring 32 is mounted around the guiding slice 314 of the engaging panel 31 between the top end of the engaging panel 31 and one of the connecting wings 112 to provide a recoil force to the engaging panel 31 to enable the engaging protrusion 313 to engage one of the engaging recesses 211 of the connecting rod 21.

In use, the reversible mortise lock in accordance with the present invention can be mounted on a side of a pull-type or a push-type storm door in a corresponding assembling direction of the bolt head 24 of the latchbolt 20. To change the assembling direction of the bolt head 24, with reference to FIGS. 2 and 5, the pushing levers 311 are pushed upwardly relative to the sidewalls 11 along the holding holes 111 and to press the second spring 32, such that the engaging protrusion 313 is disengaged from a corresponding engaging recess 211 of the connecting rod 21. Then, the connecting rod 21 can be automatically moved toward the lock body plate 13 by the elastic force of the first spring 25 to enable the bolt head 24 to extend out of the latch hole 131 of the lock body plate 13.

Figure 5:
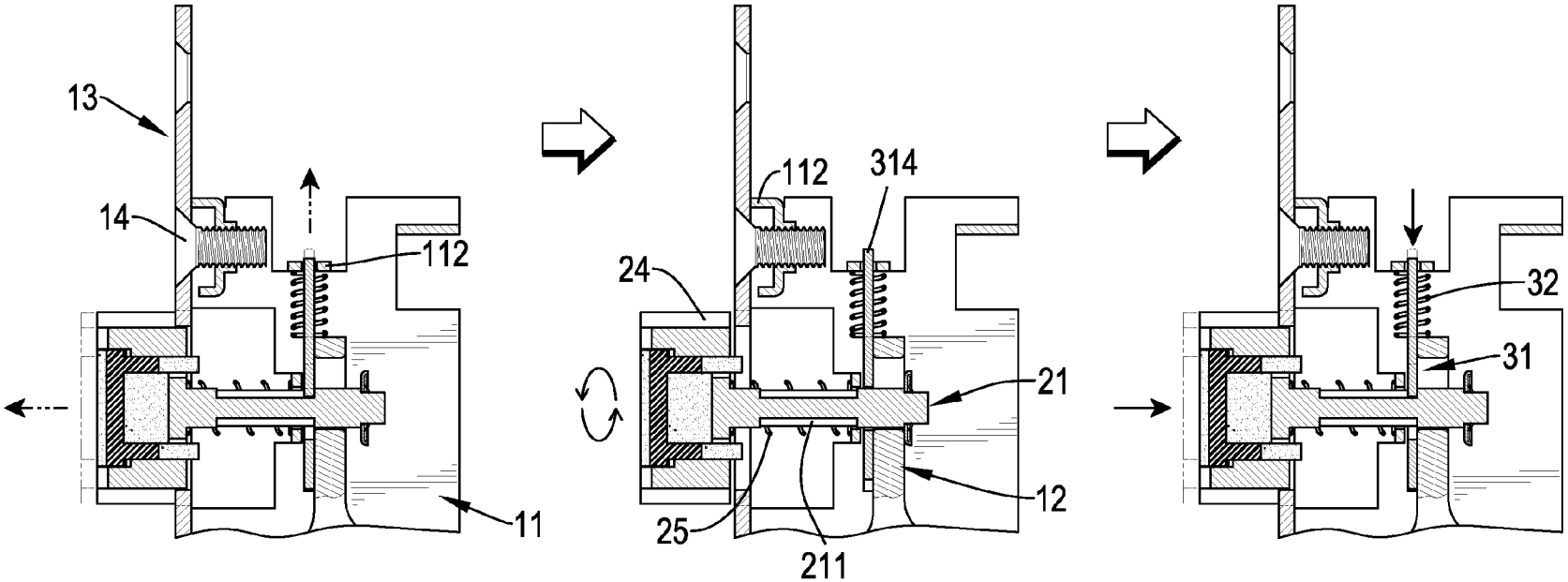
FIG. 5 are operational side views of the reversible mortise lock in FIG. 4.
Figure 6:
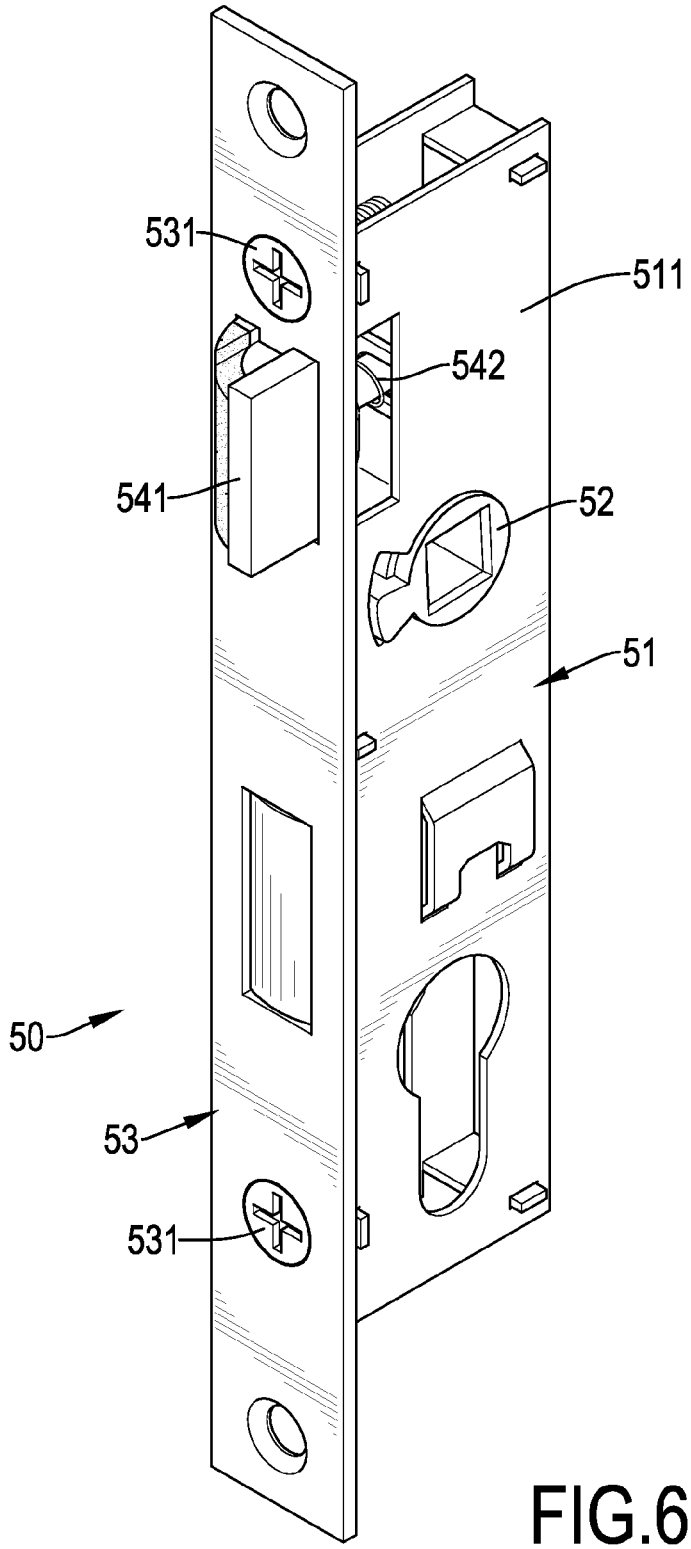
FIG.6 PRIOR ART
FIG. 6 is a perspective view of a reversible mortise lock for a storm door in accordance with the prior art.
Figure 7:
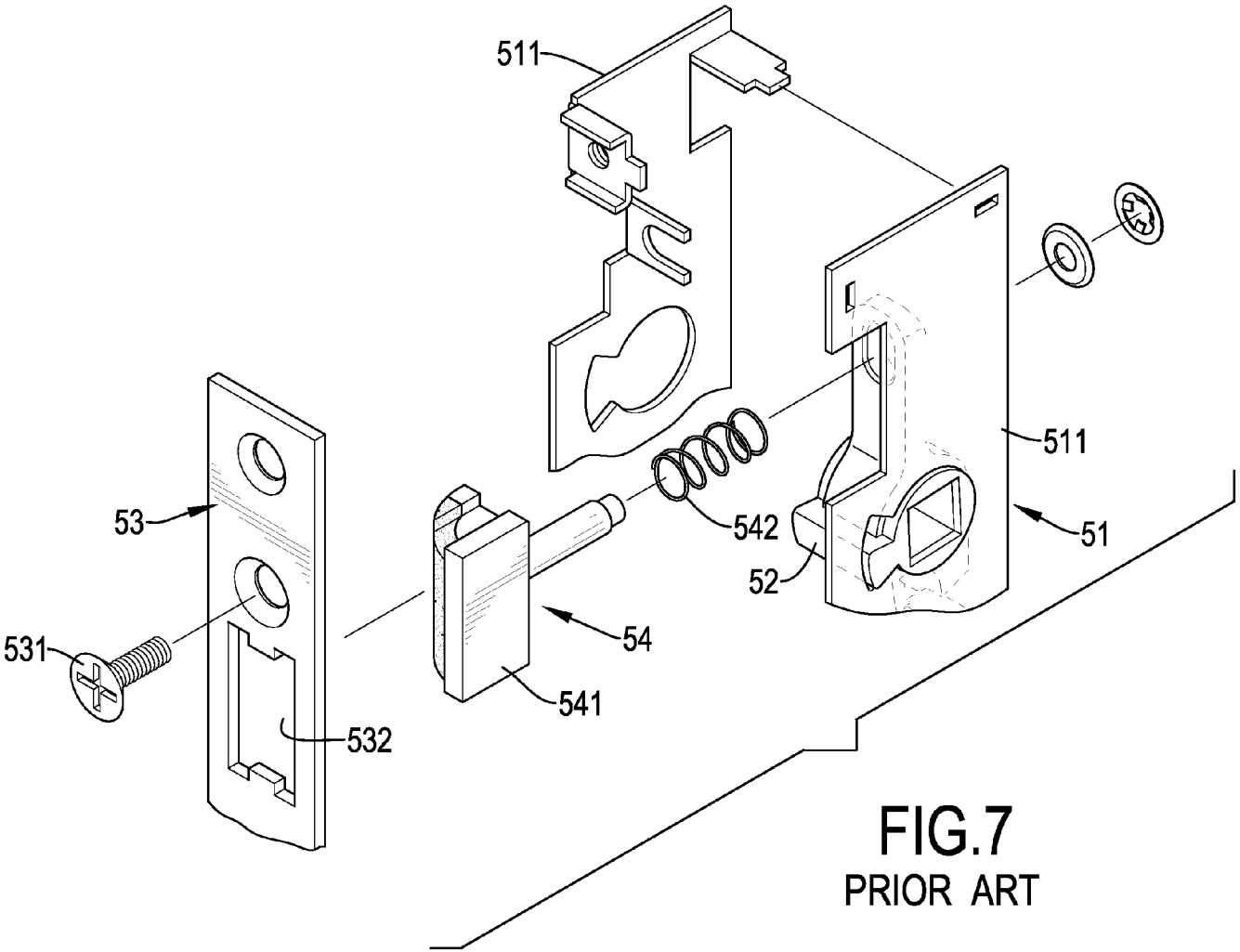
FIG.7 PRIOR ART
FIG. 7 is a partially exploded perspective view of the reversible mortise lock in FIG. 6.
Figure 8:
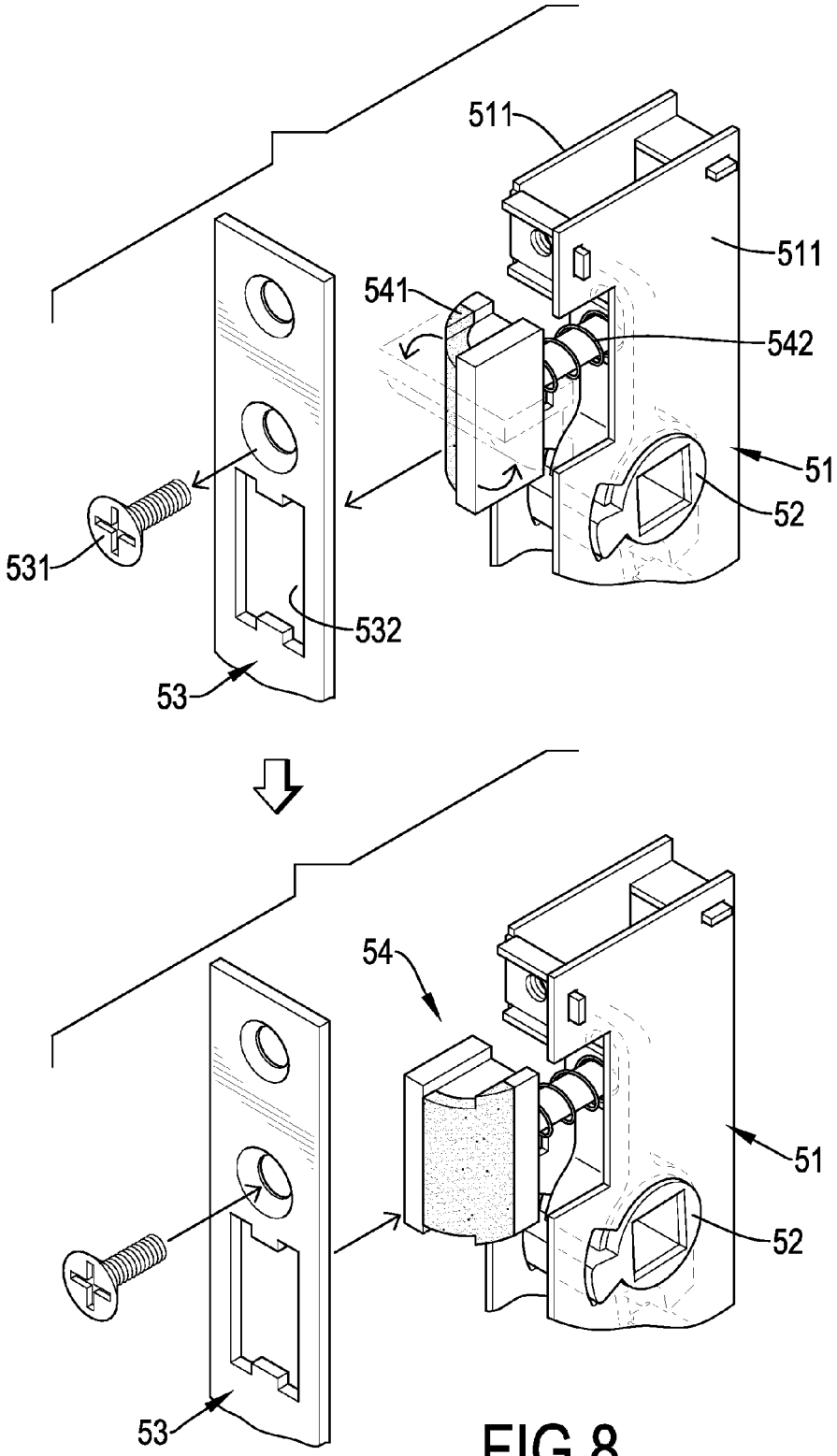
FIG.8 PRIOR ART
FIG. 8 are operational exploded perspective views of the reversible mortise lock in FIG. 6.

When the bolt head 24 completely extends out from the latch hole 131 of the lock body plate 13, the latchbolt 20 can be rotated relative to the connecting end 121 of the actuator 12 by the connecting rod 21 to change the direction of the bolt head 24. After the direction of the bolt head 24 of the latchbolt 20 is changed, the bolt head 24 is pushed inwardly relative to the sidewalls 11 of the body 10 to enable the connecting rod 21 to move to the original position and to enable the engaging protrusion 313 to move in and engage the other engaging recess 211 of the connecting rod 21 with the recoil force of the second spring 32 as shown in FIG. 5.

According to the above-mentioned operation process, the assembling direction of the bolt head 24 of the latchbolt 20 can be changed by pushing the pushing levers 311 upwardly relative to the sidewalls 11 of the body 10 and rotating the bolt head 24 of the latchbolt 20 without loosening the fasteners 14, so to change the assembling direction of the bolt head 24 of the latchbolt 20 to fit with storm doors of different types is easy and convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A reversible mortise lock for a storm door having:

a body having:

two sidewalls connected to each other by multiple connecting wings, and each sidewall having:

an outer side; and at least one holding hole formed through the sidewall and aligning with the at least one holding hole of the other sidewall;

an actuator rotatably mounted in the body between the sidewalls and having a connecting end extending upwardly between the sidewalls of the body; and a lock body plate securely connected to the outer sides of the sidewalls and having a latch hole formed through the lock body plate;

a latchbolt pressably connected to the actuator between the sidewalls and the lock body plate of the body and having:

a connecting rod movably and rotatably connected to the connecting end of the actuator and having:

an inner end extending between the sidewalls of the body and movably and rotatably mounted through the connecting end of the actuator;

an outer end extending outwardly to the latch hole of the lock body plate;

an external surface; and two engaging recesses formed in the external surface of the connecting rod between the ends of the connecting rod;

a bolt head mounted on the outer end of the connecting rod and extending to the latch hole of the lock body plate; and a first spring mounted around the connecting rod between the bolt head and one of the connecting wings of the body; and an operational set movably connected to the body and the latchbolt and having:

an engaging panel movably mounted between the sidewalls of the body, mounted around and selectively engaging the connecting rod of the latchbolt between the corresponding connecting wing and the connecting end of the bolt flower and having:

a top end;

a bottom end;

two opposite sides respectively facing the sidewalls of the body;

at least two pushing levers respectively formed on and protruding from the opposite sides of the engaging panel and respectively mounted in and extending out of the holding holes of the sidewalls of the body;

a through hole formed through the engaging panel between the ends of the engaging panel and mounted around the connecting rod of the latchbolt; and an engaging protrusion formed on and protruding from the engaging panel, extending in the through hole and selectively engaging one of the engaging recesses of the connecting rod to hold the connecting rod; and a second spring mounted between the top end of the engaging panel and one of the connecting wings to provide an elastic force to the engaging panel to enable the engaging protrusion to engage one of the engaging recesses of the connecting rod.

2. The reversible mortise lock as claimed in claim 1, wherein the engaging panel has a guiding slice formed on and protruding upwardly from the top end of the engaging panel between the sidewalls and extending into the corresponding connecting wing that abuts the second spring; and the second spring is mounted around the guiding slice of the engaging panel between the top end of the engaging panel and the corresponding connecting wing.

3. The reversible mortise lock as claimed in claim 2, wherein the latchbolt has a holding ring securely mounted around the inner end of the connecting rod to prevent the connecting rod from separating from the actuator; and a washer mounted around the connecting rod between the connecting end of the actuator and the holding ring.

4. The reversible mortise lock as claimed in claim 3, wherein each one of the sidewalls 11 of the body is rectangular.

5. The reversible mortise lock as claimed in claim 1, wherein the latchbolt has a holding ring securely mounted around the inner end of the connecting rod to prevent the connecting rod from separating from the actuator; and a washer mounted around the connecting rod between the connecting end of the actuator and the holding ring.

6. The reversible mortise lock as claimed in claim 1, wherein each one of the sidewalls of the body is rectangular.

* * * * *